US007276989B2

(12) United States Patent
Quan et al.

(10) Patent No.: US 7,276,989 B2
(45) Date of Patent: Oct. 2, 2007

(54) ATTENUATOR CIRCUIT COMPRISING A PLURALITY OF QUARTER WAVE TRANSFORMERS AND LUMP ELEMENT RESISTORS

(75) Inventors: Clifton Quan, Arcadia, CA (US); Stephen M. Schiller, La Mirada, CA (US); Yanmin Zhang, Cerritos, CA (US)

(73) Assignee: Raytheon Company, Waltham, MA (US)

( * ) Notice: Subject to any disclaimer, the term of this patent is extended or adjusted under 35 U.S.C. 154(b) by 124 days.

(21) Appl. No.: 11/143,147

(22) Filed: Jun. 2, 2005

(65) Prior Publication Data

US 2006/0273863 A1 Dec. 7, 2006

(51) Int. Cl.
*H01P 1/22* (2006.01)

(52) U.S. Cl. ..... 333/81 A; 333/35

(58) Field of Classification Search ..... 333/81 A, 333/35, 238

See application file for complete search history.

(56) References Cited

U.S. PATENT DOCUMENTS 3,091,743 A 5/1963 Wilkinson
3,648,200 A * 3/1972 Harrison et al. ..... 333/211
3,859,609 A * 1/1975 Couvillon et al. ..... 333/81 A
4,394,633 A * 7/1983 Klein ..... 333/238
5,204,643 A 4/1993 Verronen
5,345,199 A * 9/1994 Glenn et al. ..... 333/17.2
5,506,589 A 4/1996 Quan
5,712,607 A * 1/1998 Dittmer et al. ..... 333/238
6,657,514 B1 12/2003 Tokudera

OTHER PUBLICATIONS

J. Reed and G. J. Wheeler, "A Method of Analysis of Symmetrical Four Port Network," IRE Trans. MTT, vol. MTT-4, pp. 246-252, Oct. 1956.

L.I. Parad and R.L. Moyniham, "Split-Tee Power Divider," IEEE Trans. MTT, vol. MTT-13, pp. 91-95, Jan. 1965.

Mader, T., et al, "Switched-Mode High-Efficiency Microwave Power Amplifiers in a Free-Space Power-Combiner Array", IEEE MTT, vol. 46, No. 10, Oct. 1998, pp. 1391-1398.

Watson, P., et al, "Ultra-High Efficiency Operation Based on an Alternative Class-E Mode", IEEE GaAs IC Symposium Digest 2000, pp. 53-56.

Tayrani, R., "A Monolithic X-Band Class-E Power Amplifier", IEEE GaAs IC Symposium Digest 2001, pp. 205-208.

* cited by examiner

*Primary Examiner*—Benny Lee
(74) *Attorney, Agent, or Firm*—Leonard A. Alkov

(57) ABSTRACT

A microwave attenuator circuit is disclosed, including a combination of a plurality of quarter wave transformers and a plurality of resistive elements.

28 Claims, 3 Drawing Sheets

ATTENUATOR CIRCUIT COMPRISING A PLURALITY OF QUARTER WAVE TRANSFORMERS AND LUMP ELEMENT RESISTORS

BACKGROUND

Coaxial attenuators are too bulky and expensive to be implemented on many microwave systems. Distributed ferrite load material on transmission lines have difficulty in realizing repeatable and precise attenuation values because of inconsistencies in the manufacturing the bulk material. Couplers on airstripline are not practical to realize small and precise attenuation values because of difficulties in match due to the unequal even and odd modes association with that type of transmission line.

Typical lumped element attenuator configurations utilize at minimum three resistors. Each resistor value should be held to very tight tolerances, e.g. on the order of 1% or better. Often active laser trimming is employed to achieve these precise resistor values. Laser trimming is typically preformed on printed resistor-on-ceramic substrates. This operation is prohibited for many large microwave printed circuit boards using non-ceramic material (Teflon® for example) because of the risk of damaging the board by the laser.

SUMMARY OF THE DISCLOSURE

A broadband microwave attenuator circuit is disclosed, including a combination of a plurality of quarter wave transformers and a plurality of lumped element resistors.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 1A:
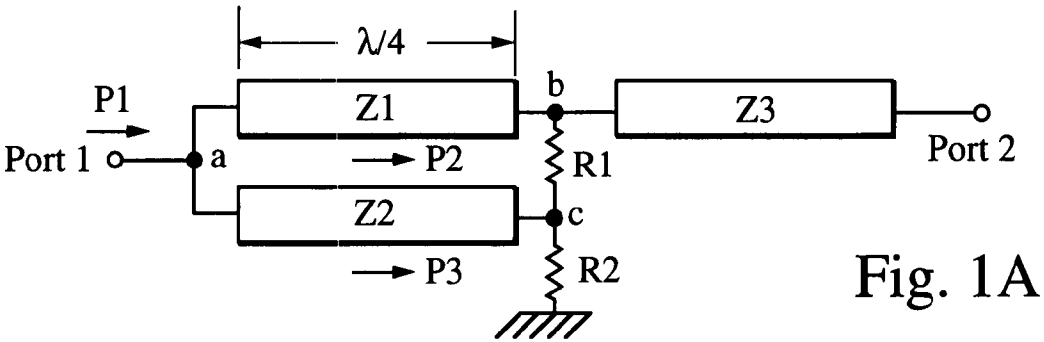
FIG. 1A is a schematic diagram of an exemplary embodiment of an attenuator device.

In the following detailed description and in the several figures of the drawing, like elements are identified with like reference numerals which may not be described in detail for every drawing figure.

An exemplary embodiment of this invention is a broadband microwave attenuator using a combination of quarter wave transformers and lumped element resistors. FIG. 1A is a schematic diagram of an exemplary embodiment of an attenuator device. RF power P1 enter into port 1, and propagates to node a, where it is split between the two quarter wave transformers characterized by impedance Z1 and Z2. A quarter wave transformer is a length of transmission line, of length equivalent to one-quarter (λ/4) wavelength at an operating frequency, functioning to transform a first impedance at a first end of the transformer into a second impedance at the second end of the transformer. The characteristic impedance of the transmission line of the transformer is equal to the square root of the product of the first impedance and the second impedance. Quarter wave (λ/4) transformers are described, for example, in "Foundation for Microwave Engineering," R.E. Collin, McGraw-Hill, 1966, Chapter five.

The impedance values of Z1 and Z2 determine the amount of power P2 that travels along the Z1 transformer, reaches node b and propagates through a quarter wave (λ/4) transformer of characteristic impedance Z3 into port 2. Quarter wave (λ/4) transformer Z3 transforms the impedance at node b to the impedance at port 3. In an exemplary embodiment, for power entering port 1, the voltage at nodes b and c will be equal, so that no current flows through resistor R1. The proper selection of impedance values Z1, Z2, resistor R2 and Z3, e.g. using even odd mode analysis, also realizes a good match at node a to the load impedance at port 2. Even-odd mode analyses are known in the art, e.g., J. Read and G. J. Wheeler,"A Method of Analysis of Symmetrical Four Port Network", IRE Trans. MTT, Vol. MTT-4, pages 246-252, Oct. 1956; L. I. Parad and R. L. Moyniham,"Split-Tee Power Divider", IEEE Trans. MTT, Vol. MTT-13, pages 91-95, Jan. 1965.

The power P3 that travels along the Z2 transformer reaches node c, and is dissipated in the resistor R2. The attenuation value of the attenuator circuit of FIG. 1 is determined by the ratio P2/P1. Choosing the proper resistor value R1 allows realization of the same attenuation value when power enter port 2 and exits port 1.

By proper selection of impedance values of R1, Z1, Z2, R2 and Z3, a good match may also be realized at port 2 using even odd mode analysis. The RF match using the configuration in FIG. 1 may be good across a 20% frequency bandwidth at microwave frequencies in one exemplary embodiment, at an exemplary center frequency of 12.5 GHz. Both R1 and R2 are used as termination load resistors and do not impact the attenuation values as does Z1 and Z2. It has been found that, for an exemplary embodiment, R1 and R2 may vary as much as 20% without impacting the attenuation. Exemplary values for Z1, Z2, Z3, R1, R2 for a circuit embodiment providing 4.7 dB attenuation are Z1 =102.8 ohms, Z2 =2.6 ohms, Z3 =59.4 ohms, R1 =106 ohms, and R2 =36 ohms. In an exemplary embodiment, the impedances presented at ports 1 and 2 may be 50 ohms.

Figure 1B:
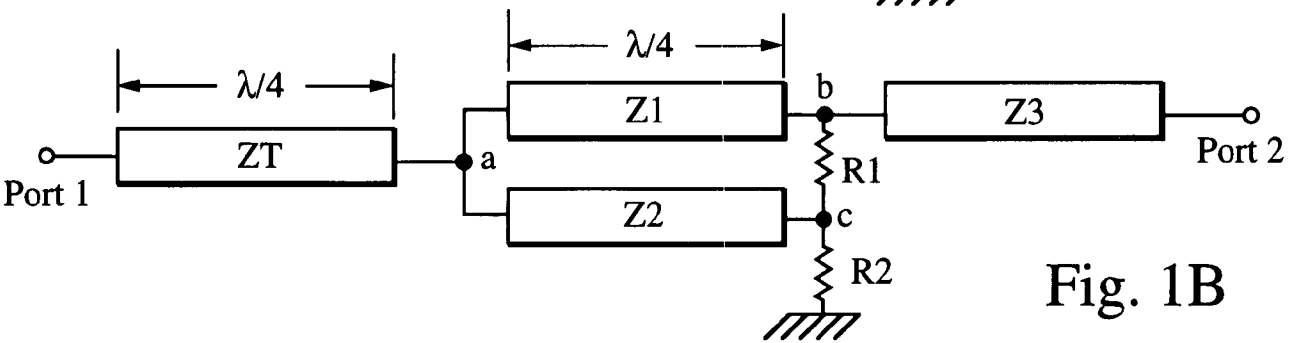
FIG. 1B is a schematic diagram of an alternate attenuator embodiment.

FIG. 1B is a schematic diagram of an alternate attenuator embodiment. By adding an addition quarter wave(λ/4) transformer ZT between node a and port 1 and adjusting the other impedance and resistance values, the bandwidth may be broadened, e.g. to up to 40% at microwave frequencies in an exemplary embodiment. An exemplary attenuator as depicted in FIG. 1B, and with ZT, Z1, Z2, Z3, R1 and R2 designed to be 41 ohms, 83 ohms, 43 ohms, 59 ohms, 100 ohms and 35 ohms respectively, has a nominal predicted 4.7 dB attenuation. Across a 4.5 Ghz bandwidth at an X/Ku band from 10.5 GHz to 14.5 GHz, the attenuation is predicted to vary by only 0.2 dB while the predicted match is better than 18 dB.

Figure 4:
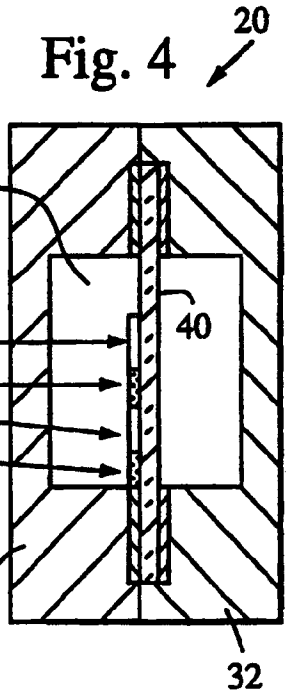
FIGS. 3 and 4 are respective left and right cross-sectional side view illustrations of the attenuator circuit of FIG. 2.
Figure 2:
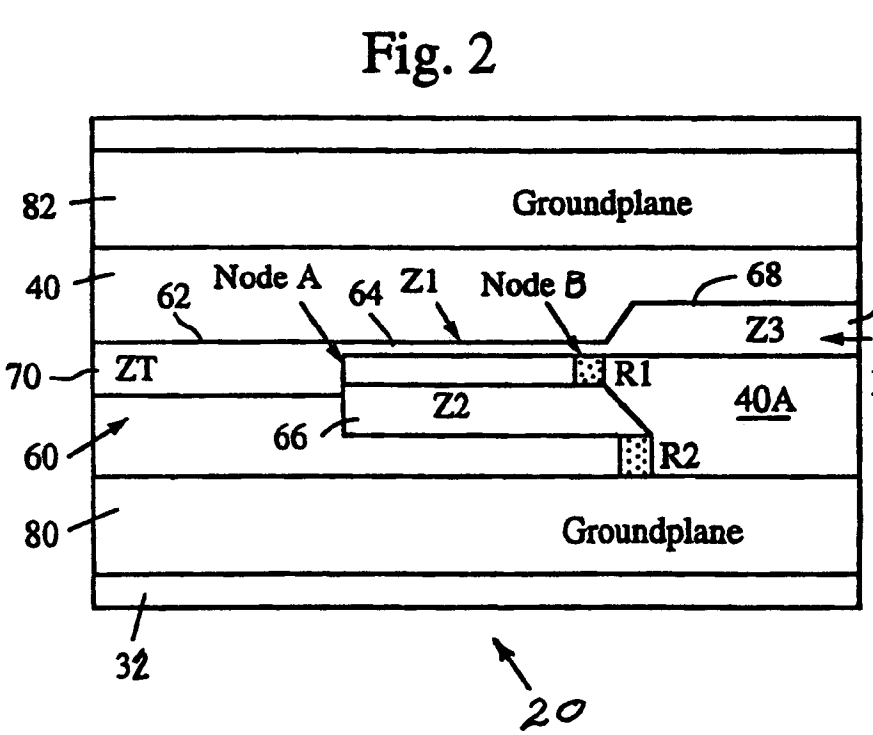
FIG. 2 is a side view of an exemplary implementation of an attenuator device according to the schematic diagram of FIG. 1B, with an upper metal housing removed to illustrate the circuit and resistor pattern formed on a surface of the dielectric substrate.
Figure 3:
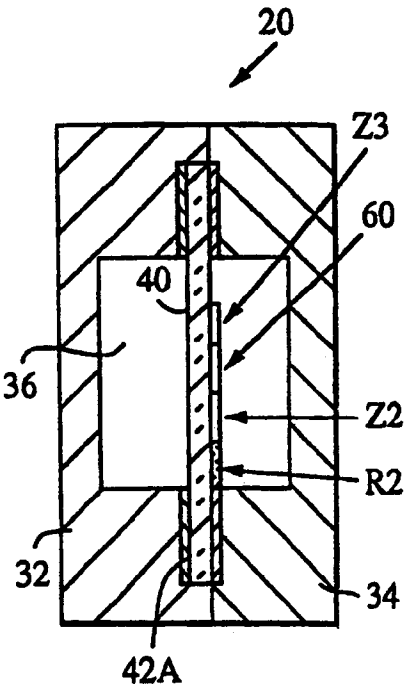

An exemplary embodiment of an microwave attenuator 20 illustrated in FIGS. 2-4 employs an etched strip transmission line pattern for each quarter wave transformer to determine an amount of attenuation through the device. Using the etched transmission line pattern can produce very precision impedance values which then result in very precise control of the attenuation values. In this exemplary embodiment, only two resistors R1 and R2 (see FIGS. 2, 4) are used to achieve a good match across the operating band, X band, for the device. These resistors can be printed onto the circuit board using resistive ink, mounted as discrete chips using, for example, a conventional solder or conductive epoxy attach method, or using a resistor product such as Ohmega-ply (TM) marketed by Ohmega Corporation.

FIGS. 3 and 4 are left and right cross-sectional side view illustrations of the attenuator 20, showing the lower and upper metal housing structures 32 and 34. These structures may be fabricated of aluminum or other suitable metal. Alternatively, the structures may be fabricated of a plastic material coated with an outer layer of conductive material such as a metal. Each of the housing structures is generally U-shaped in cross-section, so that when the housing structures are joined together as shown in FIGS. 3 and 4, an air cavity 36 is defined. The housing structure 32 has a recess 42A formed therein to receive a dielectric substrate 40.

FIG. 2 is a side view of the device 20 taken with the upper metal housing 34 (shown in FIGS. 3, 4) removed to illustrate the circuit and resistor pattern 60 formed on surface 40A of the dielectric substrate 40. The substrate can be fabricated from various dielectric materials, e.g. CuClad 250 (TM), ceramic, or 6010 Duroid (TM). The circuit pattern can be fabricated using photolithographic techniques, by way of example, wherein the surface 40A is first formed with a conductive layer, e.g. copper, covering the surface. The copper layer can be patterned using photolithographic techniques, selectively removing the copper layer to define a circuit pattern. The circuit pattern includes parallel, separated groundplane regions 80, 82 which contact surfaces of the metal housing structure 34. Matching groundplane regions may also be formed on the opposed surface of the substrate, opposite regions 80, 82.

The circuit pattern includes a conductor strip 62 having a width selected to provide a characteristic transmission line impedance ZT. At the substrate edge, the strip forms a first I/O port 70. The circuit pattern also includes conductor strips 64 and 66, each having an effective electrical length of one quarter wavelength at a frequency within the operating band, e.g. at the center frequency of the operating band. The width of strip 64 is selected to provide a characteristic transmission line impedance Z1. The width of strip 66 is selected to provide a characteristic transmission line impedance Z2. The strips 62, 64 and 66 thus provide respective quarter-wave transformer sections. In an exemplary embodiment, the conductor strip 66 has a tapered configuration at node B to reduce parasitic shunt capacitance and improve the match.

Ends of the strips 62, 64 and 66 are connected at node A. A resistor R1 is connected at the opposite end of the strip 64 at node B. Resistor R1 is electrically connected at node B between the strip 64 and the strip 66. A resistor R2 is electrically connected between the end of strip 66 and the groundplane 80. These resistors R1, R2 may be printed onto the circuit board 40 or mounted as discrete chips using, for example, a conventional solder or conductive epoxy attach method.

The circuit pattern 60 further includes a conductor strip 68 having a width selected to provide a characteristic transmission line impedance Z3. In an exemplary embodiment, the conductor strip 68 has a tapered configuration at node B to reduce parasitic capacitance and improve the match. Strip 68 has a first end electrically connected at node B to the adjacent end of strip 64. A second end of strip 68 serves as the second I/O port 72 of the attenuator device. The resistors R1 and R2 and impedances ZT, Z1, Z2 and Z3 correspond to the similarly named resistors and impedances of the schematic diagram of FIG. 1B. To implement the attenuator of FIG. 1A, the conductor strip 62 may be eliminated.

The exemplary embodiment of an attenuator shown in FIGS. 2-4 is configured as a channelized single sided air stripline or suspended substrate stripline. The attenuator can be implemented in other transmission line structures. For example, the attenuator can be implemented in channelized microstrip, channelized inverted microstrip, channelized double sided air stripline or high "Q" air stripline, as illustrated in simplified form in FIGS. 5-7, respectively.

Figure 5:
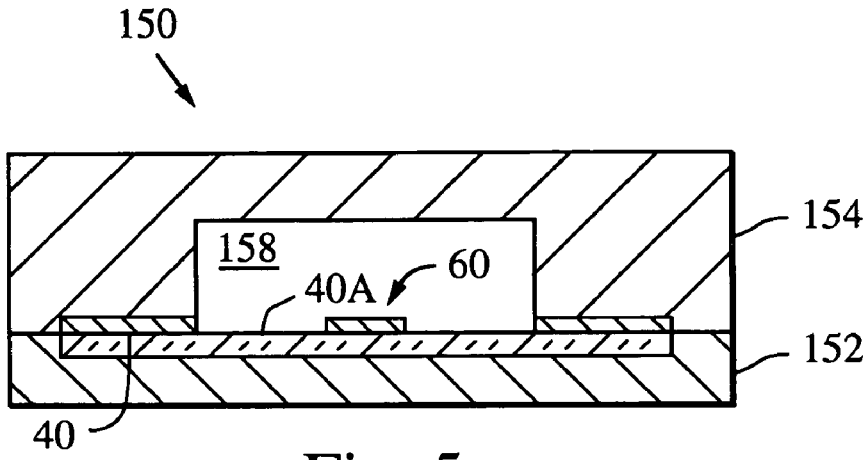
FIG. 5 illustrates in cross-section an exemplary embodiment of an attenuator fabricated in a channelized microstrip structure.

FIG. 5 illustrates in cross-section an exemplary embodiment of an attenuator 150 fabricated in a channelized microstrip structure. The attenuator 150 includes a bottom metal housing structure 152 and an upper metal housing structure 154. The bottom housing structure 152 includes a recessed region to receive the circuit board 40, which includes a circuit and resistor pattern 60 and groundplane regions formed on upper substrate surface 40A as in the embodiment of FIGS. 2-4. The top housing structure 154 has an open channel formed therein to define an air cavity 158. The lower surface of the substrate is in contact with the lower housing structure 152.

Figure 6:
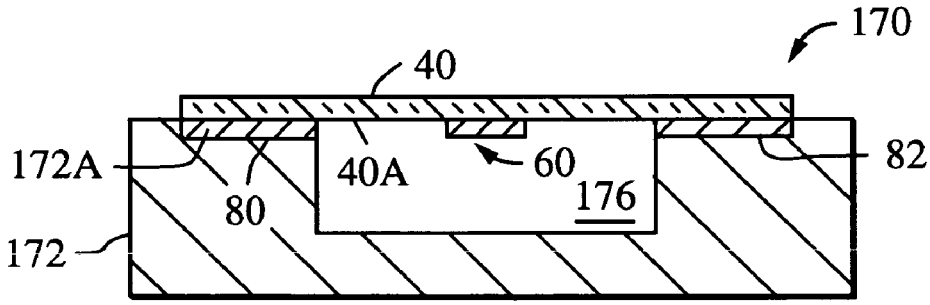
FIG. 6 illustrates in cross-section an exemplary embodiment of an attenuator device fabricated in a channelized inverted microstrip structure.

FIG. 6 illustrates in cross-section an exemplary embodiment of an attenuator device 170 fabricated in a channelized inverted microstrip structure. The attenuator 170 includes a housing structure 172 having a generally U shaped channel formed therein to define an air cavity 176. The circuit board 40 is inverted, so that the circuit and resistor pattern 60 is formed on surface 40A facing inwardly into the air cavity. The groundplane regions 80, 82 contact surfaces of a recessed region 172A of the housing structure 172.

Figure 7:
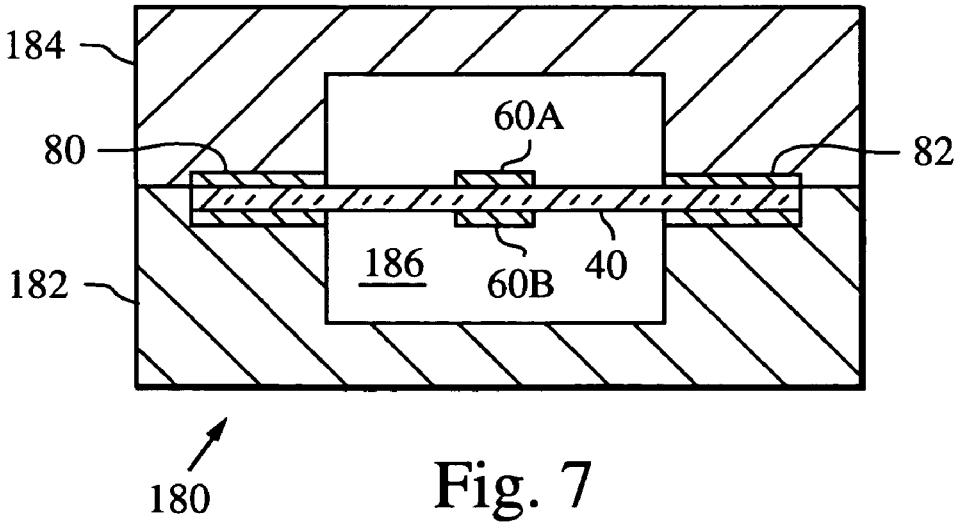
FIG. 7 illustrates in cross-section an exemplary embodiment of an attenuator device fabricated in a channelized double-sided air stripline structure.

FIG. 7 illustrates in cross-section an exemplary embodiment of an attenuator device 180 fabricated in a channelized double-sided air stripline structure. The attenuator includes lower conductive housing structure 182 and upper conductive housing structure 184. The housing structures each form a general U-shaped configuration to define an air cavity 186 when the housing structures are assembled together as shown in FIG. 7. A dielectric circuit board 40 is captured between the housing structures, and has groundplanes 80, 82 which contact mating surfaces of the upper housing structure 184. The board 40 has respective circuit and resistor patterns 60A and 60B formed on opposite sides of the board. In an exemplary embodiment, the patterns 60A and 60B are identical to each other and to the circuit pattern 60 shown in FIG. 2.

Figure 8:
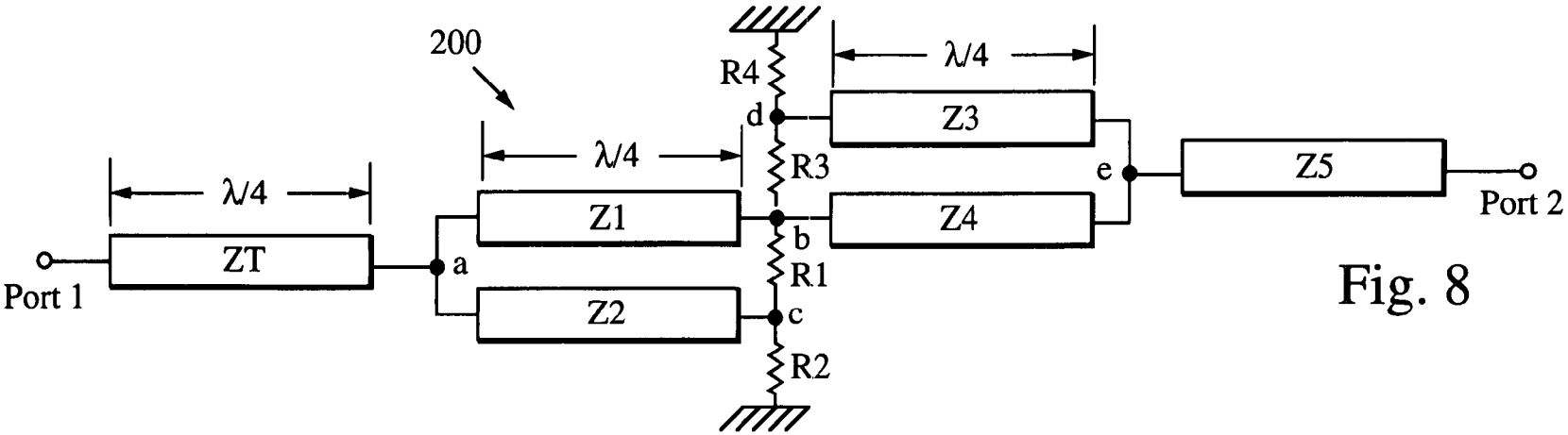
FIG. 8 illustrates in simplified schematic form another embodiment of an attenuator, wherein a back to back configuration allows a wider range of attenuation by a factor of two.

The range of attenuation for an exemplary attenuator device illustrated in FIGS. 2-4 may be limited by the achievable etched trace width of the quarter wave transformers for a given transmission line dimensional cross section. FIG. 8 illustrates in simplified schematic form another embodiment of an attenuator 200, wherein a back to back configuration allows a wider range of attenuation, e.g., by a factor of two in an exemplary embodiment. As with the embodiment of FIG. 1B, the attenuator includes quarter-wavelength (λ/4) transformers ZT, Z1 and Z2 with nodes a, b and c. The attenuator further includes a second set of quarter-wavelength (λ/4) transformers Z3, Z4 and resistances R3, R4. Resistance R3 is connected between nodes b and d, at first ends of transformers Z4 and Z3. Resistance R4 is connected between node d and a groundplane. The opposite, second ends of the transformers Z3 and Z4 are connected at node e, which is connected by another quarter wave (λ/4) transformer Z5 to port 2 of the device 200.

In an exemplary implementation of the attenuator 200 of FIG. 8, the parameters are designed to have the following values: ZT=41 ohms, Z1=88 ohms, Z2=41 ohms, R1=R3=100 ohms, R2=R4=34 ohms, Z3=41 ohms, Z4=88 ohms, and Z5=41 ohms, to provide a nominal attenuation of 8.6 dB. Across a 4.5 GHz bandwidth at X/Ku band, centered at 12.5 GHz, the attenuation is predicted to vary an exemplary embodiment by only 0.1 dB while the match is predicted to be better than 20 dB.

Although the foregoing has been a description and illustration of specific embodiments of the invention, various modifications and changes thereto can be made by persons skilled in the art without departing from the scope and spirit of the invention as defined by the following claims.

What is claimed is:

1. A two-port microwave attenuator circuit, comprising a single input port and a single output port, and a combination of a plurality of quarter wave transformers and a plurality of lumped element resistors coupled between said input port and said output port, said plurality of quarter wave transformers comprising a dielectric substrate and a conductor strip pattern disposed on the dielectric substrate, wherein:

said plurality of quarter wave transformers comprises a first quarter wave transformer and a second quarter wave transformer, said first transformer connected between a first circuit node and a second circuit node, said second transformer connected between the first circuit node and a third circuit node;

said plurality of lumped element resistors comprising a first resistor connected between said second circuit node and said third circuit node, and a second resistor connected between said third circuit node and a circuit ground.

2. The circuit of claim 1, wherein said plurality of lumped element resistors are fabricated by printing the resistors onto the dielectric substrate.

3. The circuit of claim 1, wherein said plurality of lumped element resistors are mounted on the dielectric substrate as discrete resistive chips.

4. The circuit of claim 1, wherein said plurality of lumped element resistors are mounted on the dielectric substrate as discrete resistive chips using a solder or conductive epoxy.

5. The circuit of claim 1, wherein said circuit is fabricated as a channelized single sided air stripline.

6. The circuit of claim 1, wherein said circuit is a suspended substrate stripline circuit.

7. The circuit of claim 1, wherein the circuit comprises a channelized microstrip circuit.

8. The circuit of claim 1, wherein the circuit comprises a channelized double sided air stripline circuit.

9. The circuit of claim 1, wherein said circuit has an operating frequency in an X/Ku band.

10. The circuit of claim 1, wherein the plurality of quarter wave transformers comprises a third quarter wave transformer connected between said second circuit node and said output port.

11. The circuit of claim 10, wherein said plurality of quarter wave transformers includes a fourth quarter wave transformer connected between said first circuit node and said input port.

12. A two-port microwave attenuator circuit, comprising:

a first input/output (I/O) port and a second I/O port;

a first quarter wave transformer connected between a first circuit node and a second circuit node;

a second quarter wave transformer connected between said first circuit node and a third circuit node;

a first resistive element connected between said second circuit node and said third circuit node; and a second resistive element connected between said third circuit node and a circuit ground.

13. The circuit of claim 12, wherein said first and second quarter wave transformers comprise a microstrip circuit.

14. The circuit of claim 12, wherein said first and second quarter wave transformers comprise a dielectric substrate and a conductor strip pattern disposed on the dielectric substrate.

15. The circuit of claim 14, wherein said first and second resistive elements are first and second respective lumped element resistors.

16. The circuit of claim 15 wherein said first and second respective lumped element resistors are fabricated by printing the resistors onto the dielectric substrate.

17. The circuit of claim 15, wherein said first and second lumped element resistors are mounted on the dielectric substrate as first and second discrete chips.

18. The circuit of claim 15, wherein said first and second lumped element resistors are mounted on the dielectric substrate as first and second discrete chips using a solder or conductive epoxy.

19. The circuit of claim 14, wherein said circuit is fabricated as a channelized single sided air stripline.

20. The circuit of claim 14, wherein said circuit is a suspended substrate stripline circuit.

21. The circuit of claim 14, wherein the circuit comprises a channelized microstrip circuit.

22. The circuit of claim 14, wherein the circuit comprises a channelized double sided air stripline circuit.

23. The circuit of claim 12, further comprising a third quarter wave transformer connected between said second circuit node and said second I/O port.

24. The circuit of claim 23, further including a fourth quarter wave transformer connected between said first circuit node and said first I/O port.

25. The circuit of claim 12, wherein said circuit has an operating frequency in an X/Ku band.

26. The circuit of claim 12, further comprising:

a third quarter wave transformer connected between said second circuit node and a fourth circuit node;

a fourth quarter wave transformer connected between a fifth circuit node and said fourth circuit node;

a third resistive element connected between said second circuit node and said fifth circuit node;

a fourth resistive element connected between said fifth circuit node and circuit ground.

27. The circuit of claim 26, further comprising a fifth quarter wave transformer connected between said fourth circuit node and said second I/O port.

28. The circuit of claim 27, further comprising a sixth quarter wave transformer connected between said first circuit node and said I/O port.

* * * * *